US007226209B2

(12) United States Patent
Jardine et al.

(10) Patent No.: US 7,226,209 B2
(45) Date of Patent: Jun. 5, 2007

(54) BULK BAGS

(75) Inventors: Mark H. Jardine, East Bergholt (GB); P. William Warburg, Woodbridge (GB); M. John Hawker, Hadleigh (GB)

(73) Assignee: Looplifter Limited, Woodbridge (GB)

( * ) Notice: Subject to any disclaimer, the term of this patent is extended or adjusted under 35 U.S.C. 154(b) by 470 days.

(21) Appl. No.: 10/695,638

(22) Filed: Oct. 28, 2003

(65) Prior Publication Data

US 2004/0120608 A1 Jun. 24, 2004

(30) Foreign Application Priority Data

Oct. 30, 2002 (GB) ..... 0225235.1
Apr. 4, 2003 (GB) ..... 0307769.0

(51) Int. Cl.
*B65D 33/14* (2006.01)

(52) U.S. Cl. ..... 383/24

(58) Field of Classification Search ..... 383/22–24, 383/33–35, 127, 68
See application file for complete search history.

(56) References Cited

U.S. PATENT DOCUMENTS 1,512,053 A 10/1924 Ridlinghafer
3,131,832 A * 5/1964 Strandberg et al. ..... 222/105
4,271,883 A * 6/1981 Krause ..... 383/7

(Continued)

FOREIGN PATENT DOCUMENTS

EP 0259230 A 3/1988
FR 2306134 10/1976
FR 260138 6/1988
FR 2721304 12/1995
GB 210647 2/1924
GB 340466 1/1931
GB 1097040 12/1967
GB 1468902 3/1977
GB 1549448 8/1979
GB 2050298 A 1/1981
GB 2092990 A 8/1982
GB 2097755 A 11/1982
WO WO97/37908 10/1997
WO WO99/35058 7/1999

OTHER PUBLICATIONS

Search Report, PCT/GB03/04698, 5 pgs.

*Primary Examiner*—Jes F. Pascua
(74) *Attorney, Agent, or Firm*—O'Keefe, Egan, Peterman & Enders, LLP

(57) ABSTRACT

A bulk bag for the storage and transport of bulk materials, comprises: a bottom panel; a plurality of side panels; a pair of substantially parallel collapsible tubular guide members, each tubular guide member having a first end and a second end and being secured on or adjacent to the top of a side panel; and a plurality of lifting straps; each end of each tubular guide member supporting a lifting strap and the tubular members being connected together by a first spacer; wherein the first spacer comprises at least one axially stiff elongate member and is provided with a pair of jaws at each end, each pair of jaws comprising a first jaw member and a second jaw member and being adjustable between an open position and a closed position and biased to the open position by spring means; each pair of jaws being connected to a tubular member at or adjacent to the first end thereof in a manner whereby when the jaws are in the closed position they will cause at least the first end of each tubular member to lie substantially flat and when the jaws are in the open position they will cause or permit at least the first end of each of the tubular members to adopt a shape which is suitable for receiving a tine of a fork-lift. Other aspects of the invention provide a support device for modifying a conventional bulk bag, and a spacer for use in the bag or support device.

30 Claims, 13 Drawing Sheets

U.S. PATENT DOCUMENTS 4,300,608 A 11/1981 Cuthbertson
4,457,456 A 7/1984 Derby et al.
4,499,599 A 2/1985 Polett et al.
H37 H * 3/1986 Schettino ..... 430/497
4,597,749 A 7/1986 O'Brien et al.
4,759,473 A 7/1988 Derby et al.
4,792,171 A * 12/1988 Lamy ..... 294/68.3
5,108,351 A * 4/1992 Parsons ..... 474/237
5,542,767 A * 8/1996 Hedaya et al. ..... 383/127
5,607,237 A 3/1997 LaFleur
5,842,789 A 12/1998 Derby et al.
5,865,540 A 2/1999 Derby et al.
5,993,062 A 11/1999 Shackleton
6,186,698 B1 * 2/2001 Knapp ..... 403/397
6,390,675 B1 5/2002 Jardine

* cited by examiner

BULK BAGS

This application claims priority to United Kingdom patent application serial number 0225235.1 filed Oct. 30, 2002, which is entitled "SUPPORT DEVICE", the disclosure of which is incorporated herein by reference. This application also claims priority to United Kingdom patent application serial number 0307769.0 filed Apr. 4, 2003, which is entitled "BULK BAGS", the disclosure of which is also incorporated herein by reference.

BACKGROUND OF THE INVENTION

1. Field of the Invention

The present invention relates to bulk bags for the storage and transport of bulk materials, and to support devices for making such bulk bags.

2. Description of the Prior Art

Bags for storage and transport of bulk materials, for example half-tonne, one-tonne, or two-tonne capacity bags, are typically of generally cuboid shape, formed from a fabric material such as polypropylene. Typically, the weight of fabric material will be from about 180 g/m$^2$ to 400 g/m$^2$ depending on the intended load and operating conditions. The fabric may be reinforced for extra strength.

The bags have a top which is either permanently fully open or which can be opened, for loading. The bottoms of the bags are typically provided with a discharge spout through which the contents of the bag can be emptied when the spout is opened. Alternatively, the base of the bag may be cut to discharge the contents if the bag is not to be re-used.

To enable such bags to be lifted and manoeuvred by a fork-lift truck, each bag is typically provided with a lifting strap at each corner. Such bags are often called Flexible Intermediate Bulk Containers (FIBC), or bulk bags. The term "bulk bags" will be used herein to denote such bags.

To lift a filled bulk bag, a fork-lift operator brings the tines of the fork close to the top of one edge of the filled bag so that each tine is adjacent to a lifting strap. An assistant lifts up each lifting strap to enable a tine to pass through the strap while the operator moves the tines forward over the bag. The fork-lift operator moves the tines further over the top of the bag until the tines are adjacent the rear pair of lifting straps, and the process is repeated so that the tines are disposed through the rear lifting straps. The bulk bag can then be lifted and moved.

A problem with this procedure is that there is a danger of injury to the assistant when the tines or the fork are moved. This is a particular problem when filled bulk bags are stacked high, on top of each other. The fork-lift operator is unable to see the rear pair of lifting straps when the stack is too high, and the assistant may be injured by a tine or pushed off a ladder. It is also costly to employ two men to secure the bulk bag on the fork.

If no assistant is present, the fork-lift operator must move the truck so that the tines of the fork are positioned near the front straps. He must then get out of the cab of the truck, hook the front straps over the tines, and get back in the cab. He must then drive the truck forward as far as he thinks necessary, get out again, hook the rear straps onto the tines (if he has judged the forward distance correctly), get back in the cab, drive further forward to pick up the bulk bag. The procedure is slow and can be dangerous.

To facilitate lifting of a bulk bag, it has been proposed in EP 0 259 230 to provide a rigid tubular cruciform structure to be secured in the straps of a bag so that pairs of tubes can receive the tines of a fork. In FR 2 721 304 it has been proposed to provide a similar disposable structure made of cardboard. To reduce the load to which lifting straps are subjected it has been proposed to provide bags with integral lifting slings along opposite top edges so that the load is spread out along those edges; see for example GB 1 549 448, GB 2 050 298, GB 2 092 990, and WO 97/37908. However, the use of such slings does not remove the need for a fork-lift operator either to leave the cab of his truck or to use an assistant to hook the tines of the fork-lift in the slings.

In WO 99/35058 it has been proposed to provide a bulk bag with a pair of parallel tubular guide members along the tops of opposed edges of the bulk bag. The tubular members are resilient and connected together by rigid spacing means at or adjacent to their ends. The lifting straps are supported upright by the tubular members, which function as guides for the tines of a fork-lift. This enables a fork-lift operator to insert the tines of the fork-lift through all four lifting straps in one movement and without leaving his cab. The tubular members may be formed from rubber or reinforced with a helically-wound wire of metal or a plastics material so that they lie flat when under load but revert to a predetermined sectional shape when the load is removed. The resilience of the tubular members allows stacking of filled bulk bags without significant wasted space. Bulk bags with self-raising straps are also described in U.S. Pat. No. 4,300,608. A problem we have found with such devices is that, if a heavy load is applied for a long time, the strap straps or tubular members may not recover, or not fully recover, their initial shape so that insertion of a fork-lift's tines may be difficult or impossible without manual intervention.

SUMMARY OF THE INVENTION

According to a first aspect of the present invention there is provided a bulk bag for the storage and transport of bulk materials, comprising:

a bottom panel;

a plurality of side panels;

a pair of substantially parallel collapsible tubular guide members, each tubular guide member having a first end and a second end and being secured on or adjacent to the top of a side panel; and a plurality of lifting straps;

each end of each tubular guide member supporting a lifting strap and the tubular members being connected together by a first spacer;

wherein the first spacer comprises at least one axially stiff elongate member and is provided with a pair of jaws at each end, each pair of jaws comprising a first jaw member and a second jaw member and being adjustable between an open position and a closed position and biased to the open position by spring means;

each pair of jaws being connected to a tubular member at or adjacent to the first end thereof in a manner whereby when the jaws are in the closed position they will cause at least the first end of each tubular member to lie substantially flat and when the jaws are in the open position they will cause or permit at least the first end of each of the tubular members to adopt a shape which is suitable for receiving a tine of a fork-lift.

The bottom panel and the side panels may be separately formed and joined together, or some or all of the panels may be of unitary construction.

We have found that by providing spring means in the spacer or its jaws, problems of insufficient opening of the tubular members may be overcome. Any suitable spring means may be used, but a preferred spring means is at least one coil spring, notably of metal. Such springs are of low cost and are readily available in a range of strengths and sizes. Preferably two springs are provided for the spacer, each preferably close to a tubular member to improve the transmission of spring force thereto.

In a preferred embodiment, the spacer comprises a pair of axially stiff elongate members connected together by spring means, each end of one of the elongate members comprising one of the first jaw members and each end of the other elongate member comprising one of the second jaw members. The invention will for convenience be described with reference to this preferred embodiment. However it will be understood that alternative embodiments also fall within the scope of the invention. For example, the spring means could be provided by the elongate members themselves, which could be formed in whole or in part from a spring material, notably from spring metal. A pair of elongate members could also be connected scissor-fashion, so that one end provides a first jaw member of one of the pair of jaws and the other end provides a second jaw member of the other of the pair of jaws. The jaws may be connected together around the outside portion of each tubular member, so that the spacer could comprise a band, notably of spring metal. It will be appreciated that the spacer needs sufficient axial stiffness to maintain the necessary separation between the tubular members to enable the tines of a fork-lift, suitably spaced apart, to be inserted into the tubular members. The spacer therefore need not be totally axially unyielding, particularly where the tubular members are dimensioned to allow some tolerance for receiving the tines.

For efficiency of operation, both lower jaw members of the spacer are preferably secured directly to a tubular member. However, either or both of the lower jaw members of the spacer could instead be secured indirectly to a tubular member. This could be achieved, for example, by fixing the lower jaw to a panel of the bag or integrally forming the lower jaw with such a panel, the panel in turn being connected to the tubular member.

A single sprung spacer is sufficient to permit opening of the first ends of the tubular guide members to permit access to the tines of a fork-lift. The guide members may then be opened out by the tines as the tines are progressively pushed through the tubes. A second spacer is not needed to permit engagement of the bag by the tines of a fork-lift, although provision of a second spacer between the second ends of the guide members may be desirable to permit access of the tines from either end.

The guide members may be permanently or releasably secured to the side panels, and the spacer or spacers may be permanently or releasably secured to the guide members.

The bag may be manufactured with the spacer and tubular guide members built-in, or a conventional bulk bag may be modified by securing a suitable support device to it, notably by means of the bag's lifting straps. The conventional bag may optionally have the straps secured to fabric tubes formed from the material of the bulk bag, and this may be modified to form a bag in accordance with the invention by fitting a suitable spacer.

The spacers may be manufactured and sold separately. Accordingly, a further aspect of the invention provides a spacer for securing between substantially parallel tubular guide members on opposed top edges of a bulk bag, the spacer comprising at least one axially stiff elongate member and being provided with a pair of jaws at each end; each pair of jaws comprising a first jaw member and a second jaw member and being adjustable between an open position and a closed position and biased to the open position by spring means.

For convenience, the invention will be described with reference to a preferred embodiment in which a pair of spacers are connected between, respectively, first and second ends of a pair of tubular guide members. This arrangement provides a support device for securing to a conventional bulk bag to enable all four lifting straps of the bag to be raised to receive the tines of a fork-lift.

In a preferred embodiment, each elongate member of each spacer is connected to each tubular member at a substantially opposite surface to that to which the other elongate member is connected. For convenience, the invention will be described with reference to this preferred arrangement, which facilitates full opening of the tubular members. However, the connections could be circumferentially closer together if full opening of the tubular members is not necessary for them to receive the tines of a fork-lift, or if the tubular members have some resilience or elasticity so that they will spontaneously open further once they have been partially opened by the elongate members.

The elongate members should be sufficiently stiff to maintain the necessary separation between the tubular members to enable them to receive the tines of a fork-lift. The elongate members may be formed from any suitable structural materials, for example metal, wood, or structural plastics materials such as nylon, polycarbonate, polypropylene, polyethylene or other thermoplastics material. For strength and lightness a cellular or corrugated structure is preferred. A particularly preferred material is extruded cellular polypropylene sheet, or "corrugated polypropylene", which combines lightness, strength, and low cost. A corrugated polypropylene which we have found works well is Correx® from Kaysersberg Plastics, Gloucester UK. Correx® is an extruded material which essentially comprises front and back sheets of polypropylene separated by webs of polypropylene to define a row of parallel channels of substantially square cross section. A preferred thickness is in the range 6 to 10 mm, notably about 8 mm (1800 g/m$^2$). The upper limit is practical rather than critical. Additional thickness adds weight and increases manufacturing costs without providing a technical benefit.

The elongate members may be connected together only by the spring means; for example they may comprise a pair of opposed planks with one or more springs connected between them. In a preferred embodiment, however, the elongate members are also hingedly connected together along a long edge so that the spring means functions to bias the elongate members to a rest configuration in which the free long edges are separated by a specified distance. The invention will, for convenience, be described with reference to this preferred embodiment hereinafter.

The tubular members need to be able to withstand the large sideways crushing forces exerted on them by the lifting straps of the bulk bags when loaded. The tubular members may be formed from a plastics material, notably a thermoplastic material. Suitable plastics materials include nylon, polycarbonate, polypropylene and polyethylene. For increased strength the material may be cellular or corrugated. A particularly preferred material for the tubular members is a corrugated polypropylene, typically of a thinner material than that used for the spacers. A preferred thickness of Correx® is 2 to 4 mm, notably about 3 mm (450 g/m$^2$).

The tubular members may be of any suitable width to accept the tines of a fork-lift; for example they may have a diameter in the range 100 to 300 mm, notably about 200 mm.

The tubular members may be of any sectional shape which will accept the tines of a fork-lift, for example circular, square, rectangular, or oval in cross section. However, it is preferred that they have a polygonal shape which resists inward folding when being flattened. Particularly preferred shapes are a hexagon or an octagon.

The device may support the lifting straps of a bulk bag by having those straps disposed around the tubular members or integrated with the tubular members. However it is preferred that each tubular member is provided with a slot or cut-out portion adjacent each end to receive at least a top portion of each strap, so that when the tines of a fork-lift are inserted into the tubular members under the top portions of the straps and lifted, the weight of the bulk bag will be carried by the straps. Tabs may be provided on the tubular members to cover the lifting straps and help retain the straps on the support device. Locking tabs may be provided on the strap-cover tabs to keep the strap-cover tabs in position over the straps.

A support device for modifying a conventional bulk bag may be separately manufactured and sold. Accordingly another aspect of the invention provides a support device for securing to a bulk bag comprising a bottom panel, a plurality of side panels and a plurality of lifting straps, the device comprising a pair of substantially parallel collapsible tubular guide members each having a first end and a second end and which are connected together by a first spacer;

wherein the first spacer comprises at least one axially stiff elongate member and is provided with a pair of jaws at each end, each pair of jaws comprising a first jaw member and a second jaw member and being adjustable between an open position and a closed position and biased to the open position by spring means;

each pair of jaws being connected to a tubular member at or adjacent to the first end thereof in a manner whereby when the jaws are in the closed position they will cause at least the first end of each tubular member to lie substantially flat and when the jaws are in the open position they will cause or permit at least the first end of each of the tubular members to adopt a shape which is suitable for receiving a tine of a fork-lift.

The tubular members may be of unitary construction, or they may comprise an inner tube and an outer tube. This arrangement may be desirable where the outer tubes are permanently secured to the bulk bag, perhaps formed from the relatively inexpensive material of the bulk bag, optionally with strengthening means incorporated. The inner tubes may be secured at each end of a spacer by releasable securing means, and those securing means may be used to releasably secure together the spacer and both the inner and outer tubes.

In addition to facilitating lifting of the bags, we have found that the invention also provides advantages in stacking of the bags. Typically, filled bulk bags may not be stacked more than three high because the stack tends to become progressively more tilted and unstable the more bags are stacked. However, bags according the invention, or bags fitted with a device in accordance with the invention, have less tendency to tilt or slip. Accordingly, they may be stacked higher and more safely. To enhance stackability, it is preferred that the spacers, although axially stiff, are formed from a material or materials that have some lateral flexibility so that they can at least partly conform to the shape of the bag beneath or to the shape of surfaces between bags when stacked. We have found that spacers formed from corrugated polypropylene (for example, Correx®) are particularly suitable in this respect. The invention therefore also provides a device for improving stacking of filled bulk bags.

Other aspects and benefits of the invention will appear in the following specification, drawings and claims.

BRIEF DESCRIPTION OF THE DRAWINGS

The invention will now be further described, by way of example, with reference to the following drawings wherein.

Figure 2:
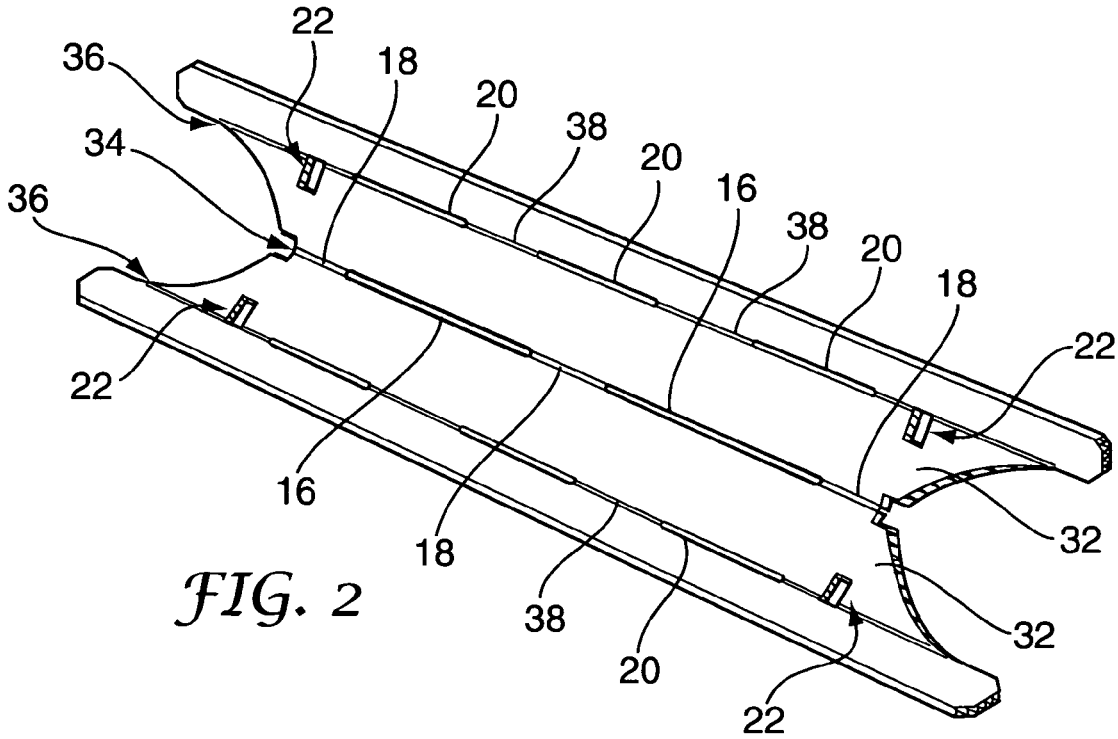
FIG. 2 is a front perspective view of a spacer of the support device of FIG. 1.
Figure 22:
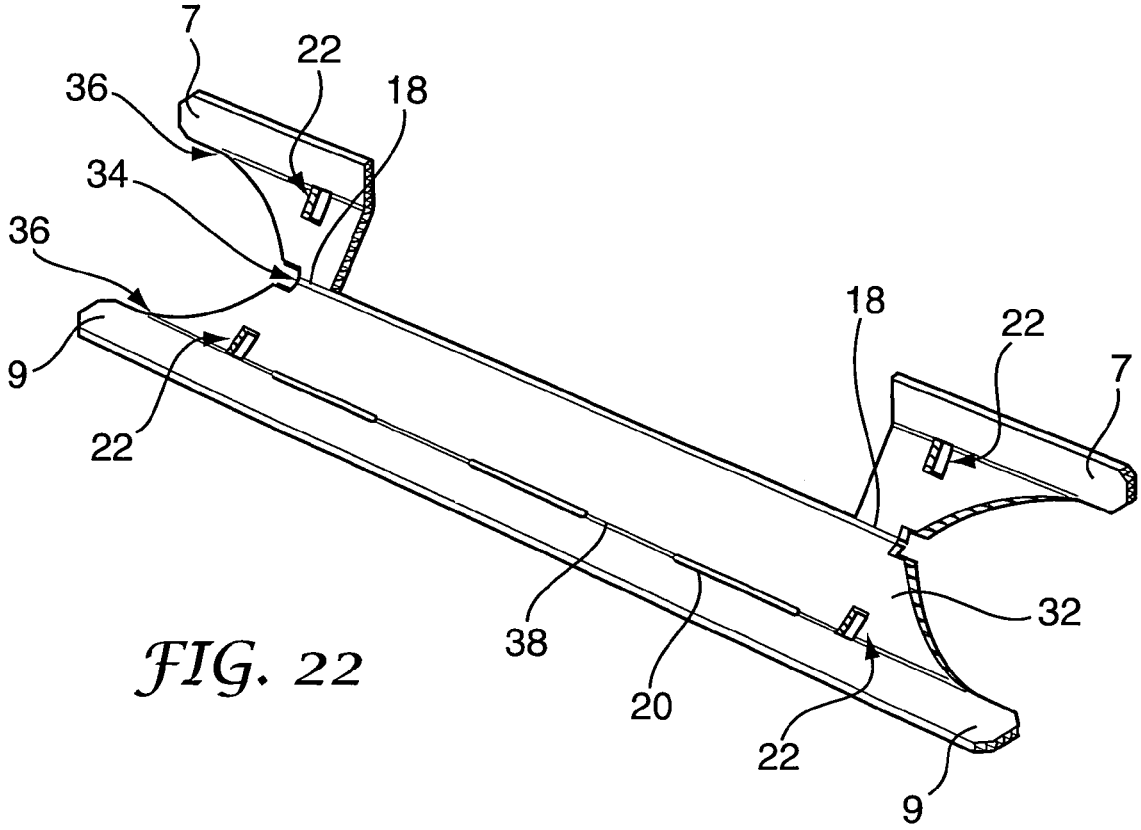
FIG. 22 is a front perspective view, similar to that of FIG. 2. of another embodiment of a spacer.
Figure 23:
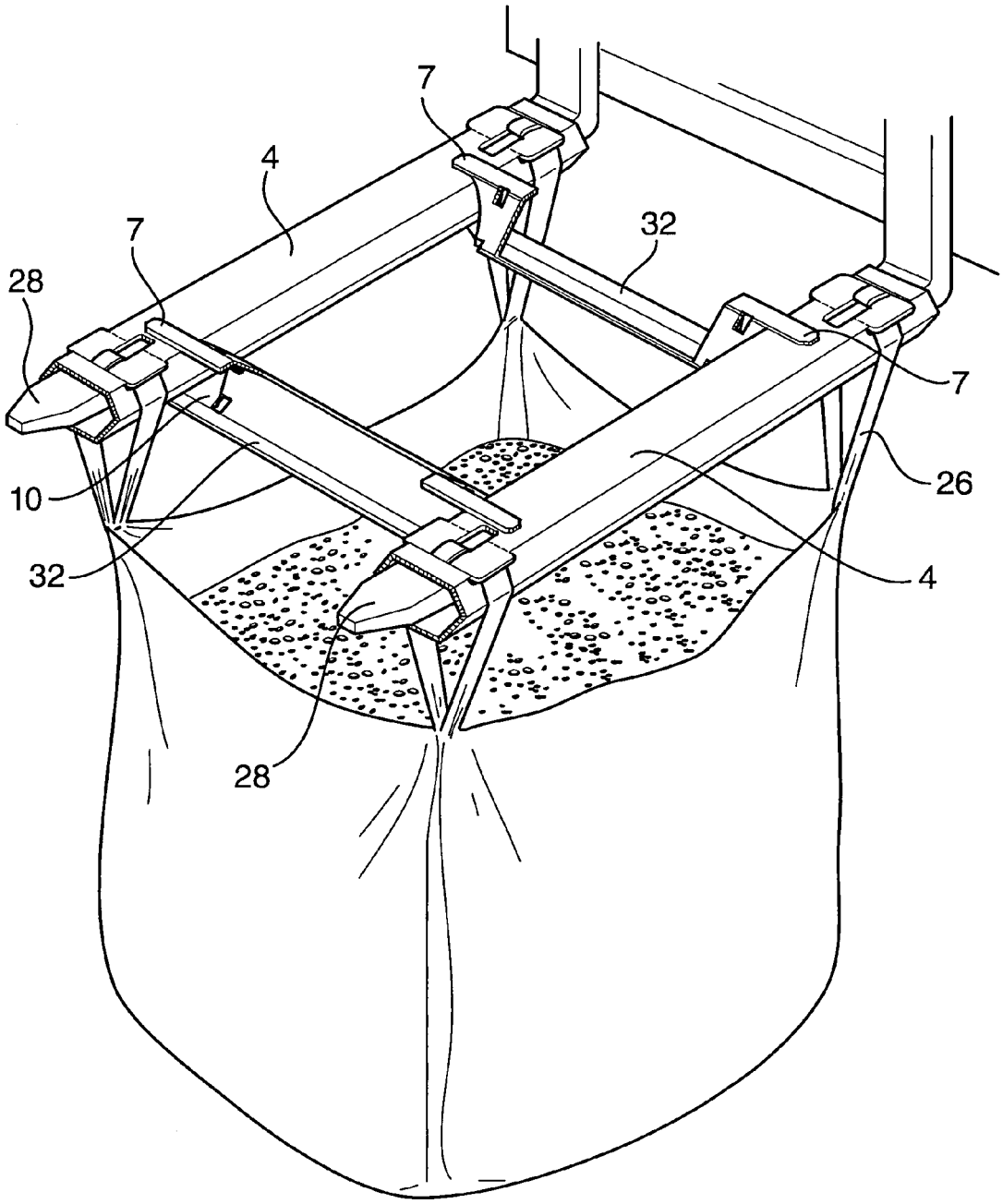
FIG. 23 is a view, similar to FIG. 8. of a support device according to another embodiment of the invention mounted on a bulk bag being lifted by a fork-lift.

The embodiment of spacer shown in FIG. 22 is similar to that of FIG. 2. This embodiment of spacer is shown in use in a support device secured to a bulk bag in FIG. 23, which is similar to FIG. 8. The spacer and device shown in FIGS. 22 and 23 operate in the same manner as those of FIGS. 2 and 8.

DETAILED DESCRIPTION

Figure 1:
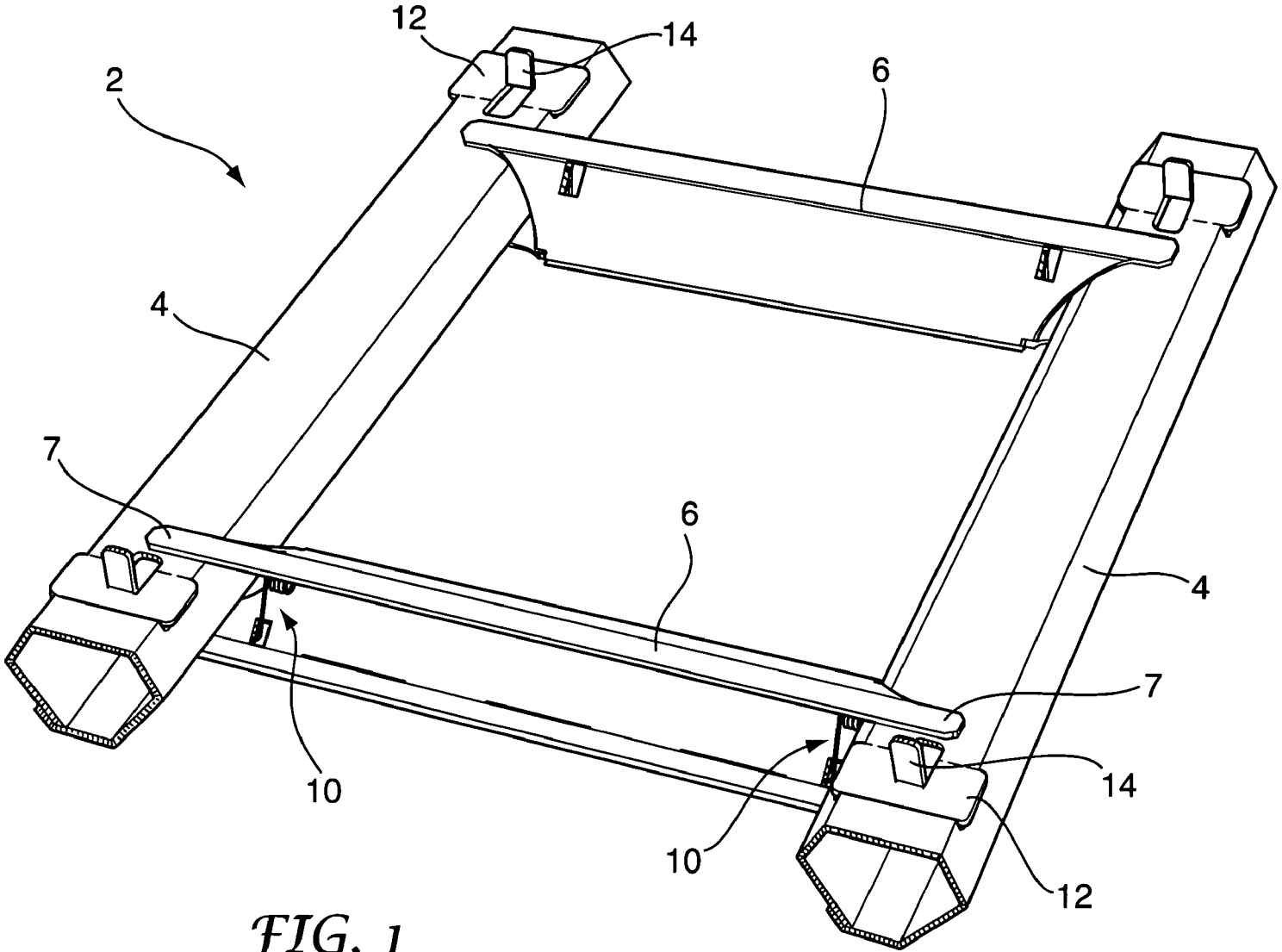
FIG. 1 is a perspective view of a support device in accordance with an embodiment of the present invention.
Figure 7:
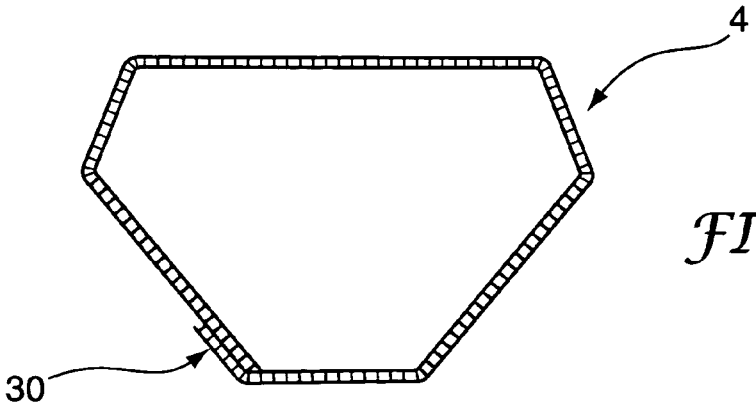
FIG. 7 is an end elevational view of a tubular member of the support device of FIG. 1.

The support device 2 shown in FIG. 1 comprises a pair of collapsible tubular guide members 4 connected together near their ends by spacers 6. Each tubular member 4 has a hexagonal cross section and is formed from 3 mm thick 450 g/m$^2$ Correx® corrugated polypropylene. The tubular members 4 are formed by cold-rolling score lines in a sheet of Correx® to define fold or hinge lines, and then hot-welding the sheet to itself at an overlapping region 30, as best shown in FIG. 7. The tubular member 4 has a hexagonal sectional shape, with a flat top and flat bottom. The two side pieces are opposed to each other with substantially equal circumferential edge lengths above and below them. This facilitates flattening of the tubular members under a suitable load in a controlled manner and without inward folding of the walls which would interfere with full flattening of the tubes.

Figure 6:
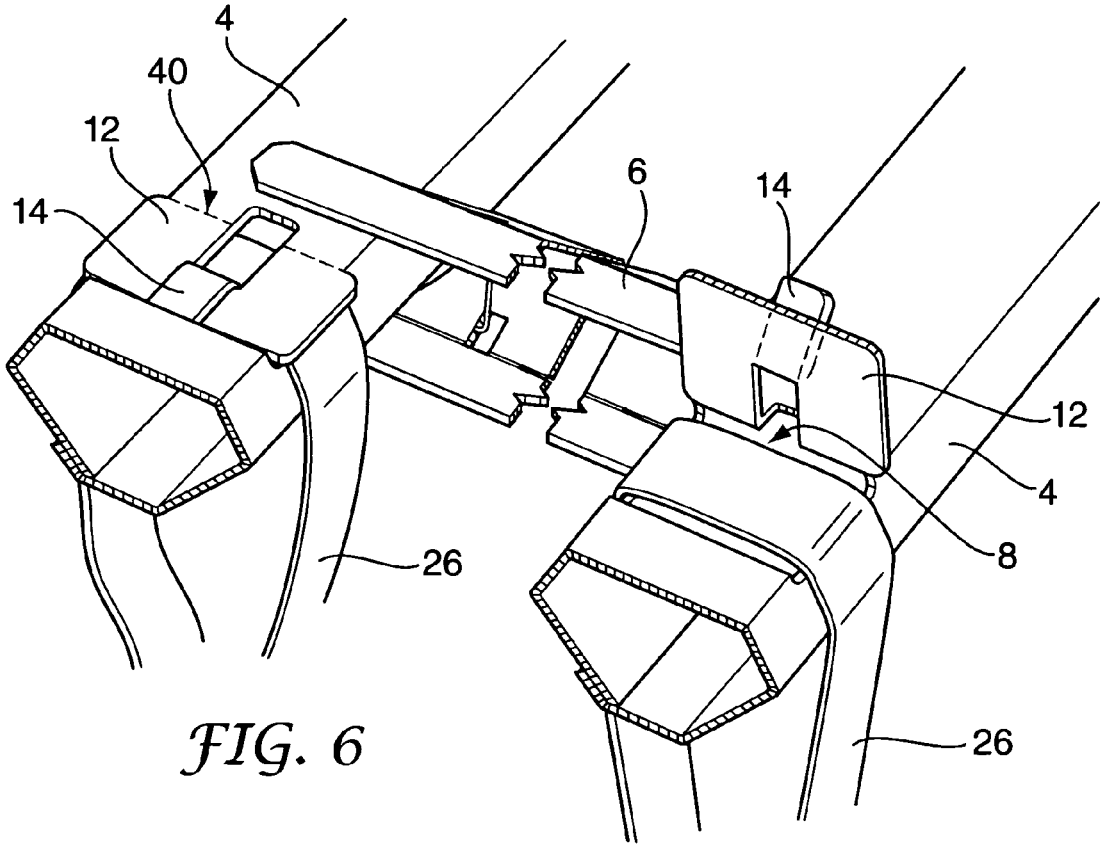
FIG. 6 illustrates stages of the securing of lifting straps of a bulk bag to the support device of FIG. 1.

Near the end of each tube there is partially cut out a strap-cover tab 12 and, from a region either side of the hinge 40 of the strap-cover tab 12, a locking tab 14. These tabs 12, 14 are used to secure the lifting straps 26 of a bulk bag to the support device 2 as best shown in FIG. 6. With the strap-cover tab 12 lifted up, a lifting strap 26 of a bulk bag is located in the resulting cut-out portion 8 of the tubular member 4 (right side of FIG. 6). The strap-cover tab 12 is then pushed down and locked in place over the strap 26 by tucking the locking tab 14 under the edge of the cut-out portion 8 opposite the hinge 40 (left side of FIG. 6). This arrangement holds the lifting straps 26 securely in the tubular members 4. For even greater security, more than one locking tab 14, for example two locking tabs, may be provided on each strap-cover tab 12. The strap-cover tabs 12 are cut so as to be wider than the width of the top flat surface of the tubular members 4, thereby providing a gap at each side sufficient to accommodate the lifting straps 26.

Figure 3:
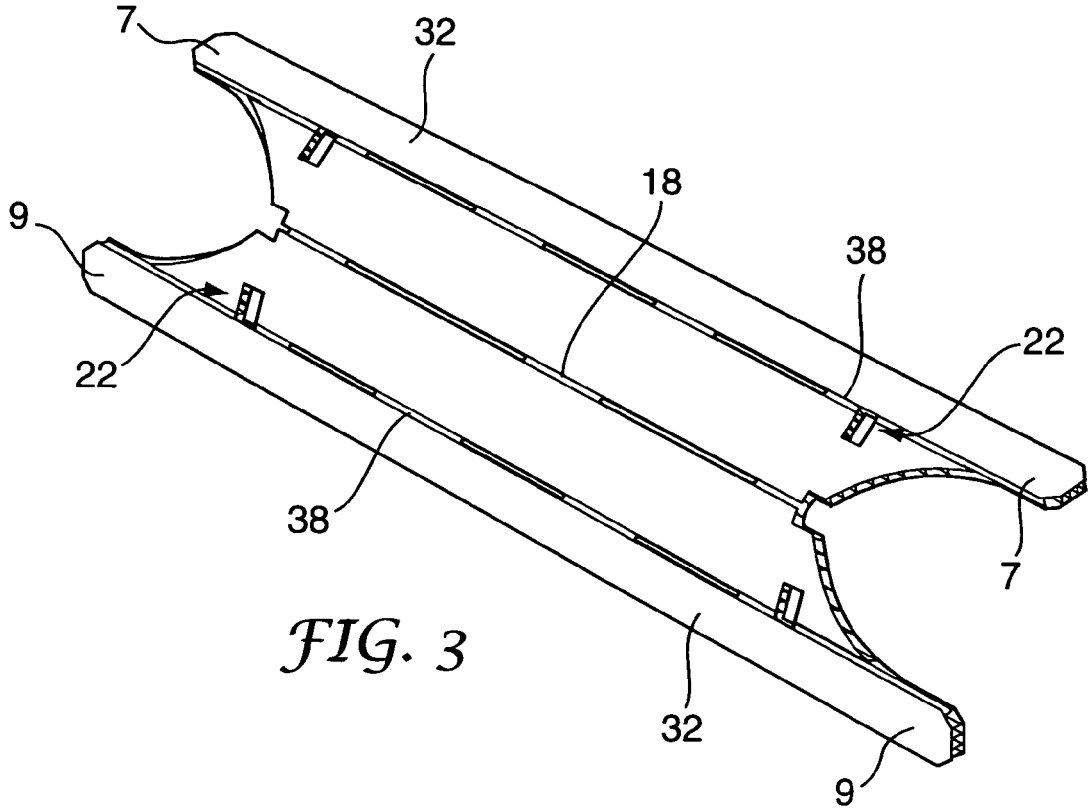
FIG. 3 is a rear perspective view of the spacer of FIG. 2.

Each spacer 6 comprises a pair of parallel stiff elongate members 32, in this example connected by central hinge portions 18, as best shown in FIGS. 2 and 3. Each end of each elongate member comprises a first jaw member 7 and a second jaw member 9 and is secured to a surface of a tubular member 4 by securing means, in this example, a heat weld. The spacer 6 is formed from a single sheet of Correx® corrugated polypropylene (8 mm thick, 1800 gsm). The Correx® is cut to the desired shape, and three parallel axial slits are cut in the back surface, defining a central hinge line 34 and side hinge lines 36. Central slots 16 are cut out so as to leave central hinge portions 18, and side slots 20 are cut out to leave corresponding side hinge portions 38. The slitting of the back surface of the Correx® causes the spacer 6 to bow inwardly.

Figure 4:
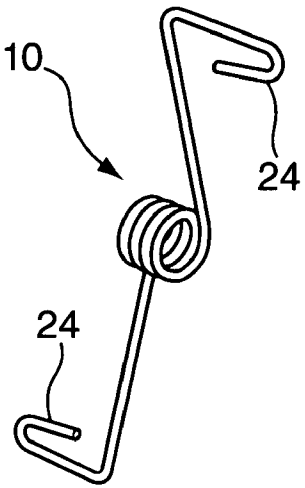
FIG. 4 is a perspective view of a spring for the support device of FIG. 1.
Figure 5:
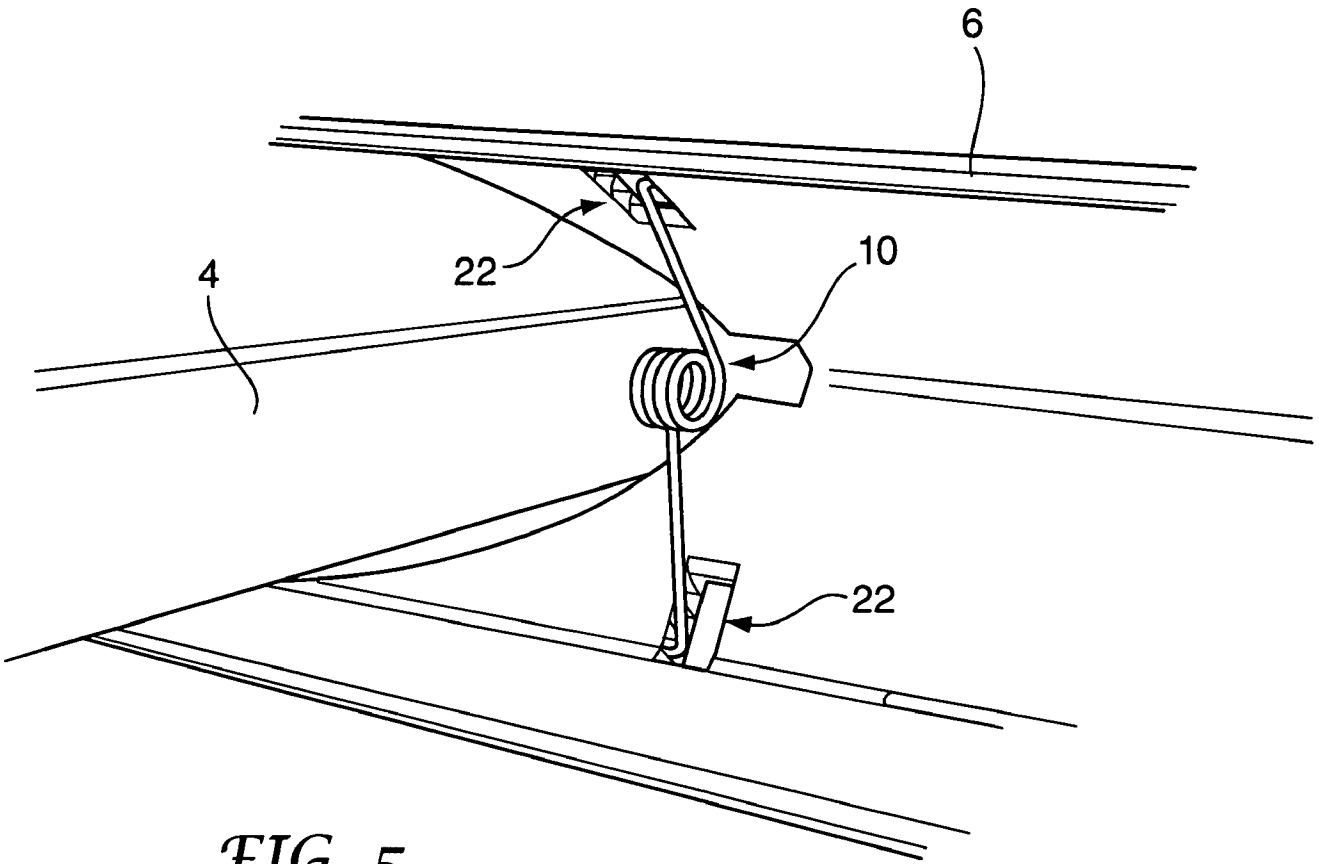
FIG. 5 shows the mounting of a spring in the support device of FIG. 1.
Figure 8:
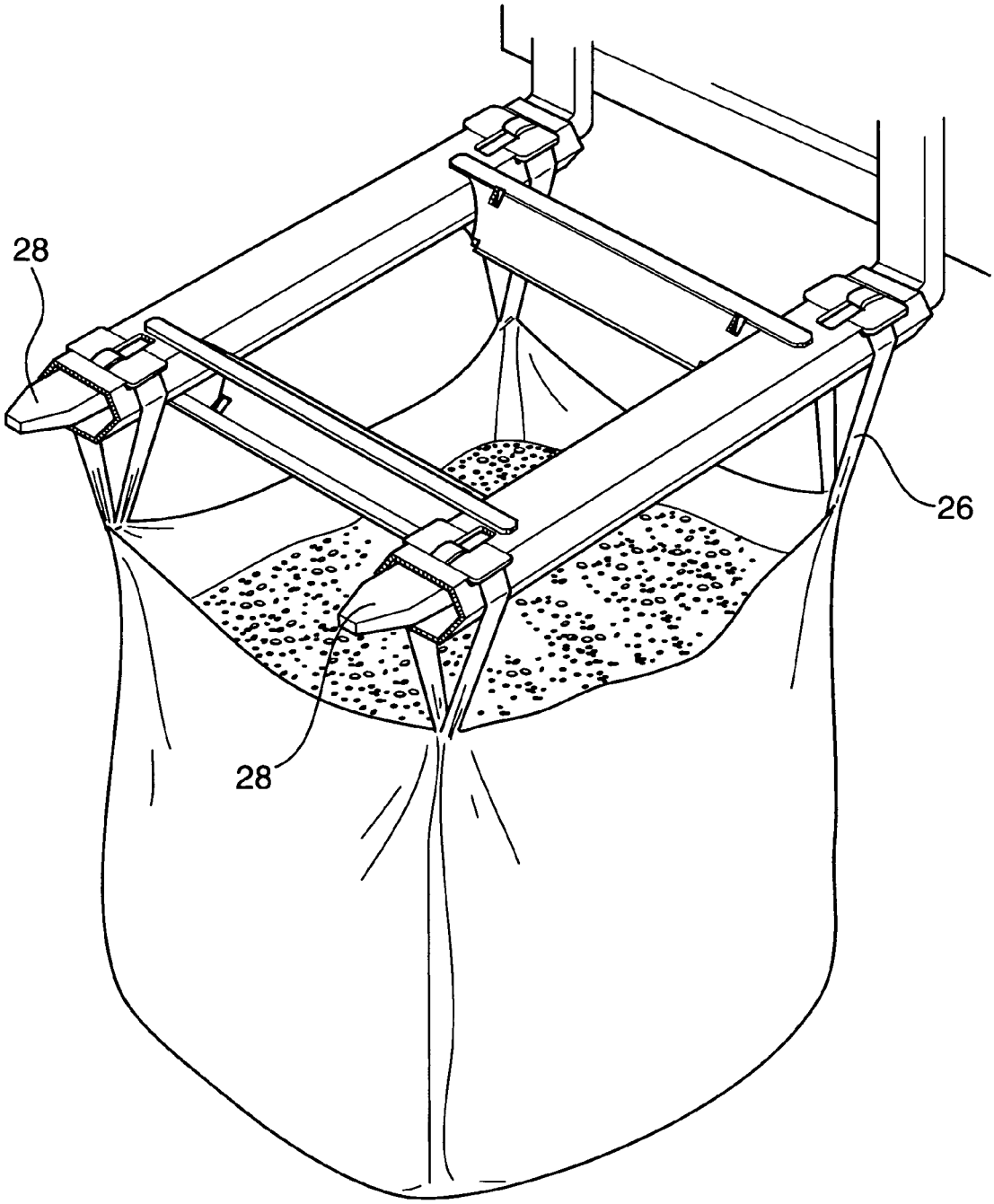
FIG. 8 shows the support device of FIG. 1 mounted on a bulk bag to provide a bulk bag in accordance with another aspect of the invention, being lifted by a fork-lift.

Holes 22 are provided near the ends of the elongate members 32 to enable the mounting of springs 10. Referring to FIG. 4, each spring 10 in this embodiment is a coil spring of 2 mm spring metal and provided with a barb 24 at each end (European Springs and Pressings, Beckenham, UK). Referring now to FIG. 5, each barb 24 is inserted into a flute of the Correx® in a side of the hole 22. The barb 24 bends the flute and engages with it so as to prevent or inhibit removal of the spring 10 from the spacer 6. The springs 10 permit the spacer 6 to be folded flat when under load so that the elongate members 32 lie on top of each other, but they urge the elongate members apart when the spacer 6 is flat and will restore the spacer 6 to a rest configuration in which the free edges of the elongate members are spaced apart when the load is removed. In this rest configuration, as shown in FIG. 1, the elongate members hold the tubular members 4 open to receive the tines 28 of a fork-lift, as illustrated in FIG. 8. The tubular members 4 act as guides for the tines 28 but they do not carry the load, which is borne by the lifting straps 26 of the bulk bag.

The tubular members 4 will lie flat when under an applied load, for example when a filled bulk bag is staked on top, but will be returned to the illustrated hexagonal sectional shape by the action of the spacers when the load is removed.

Figure 9:
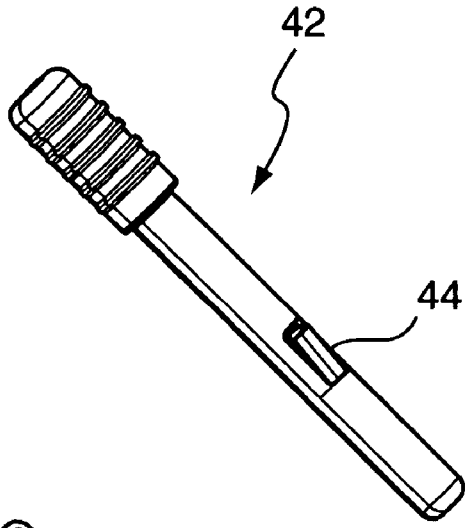
FIGS. 9 and 10 are, respectively, views from above and below a pin for a fastener for use in an embodiment of the invention.
Figure 10:
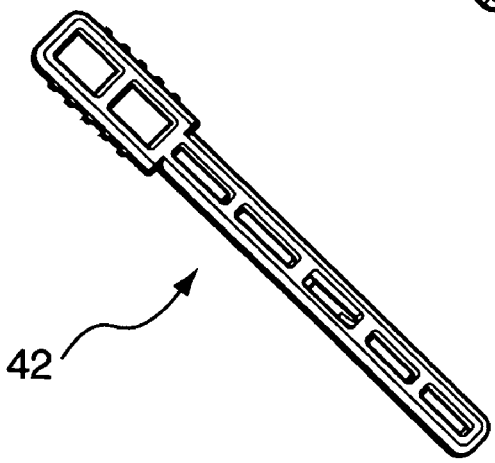
Figure 11:
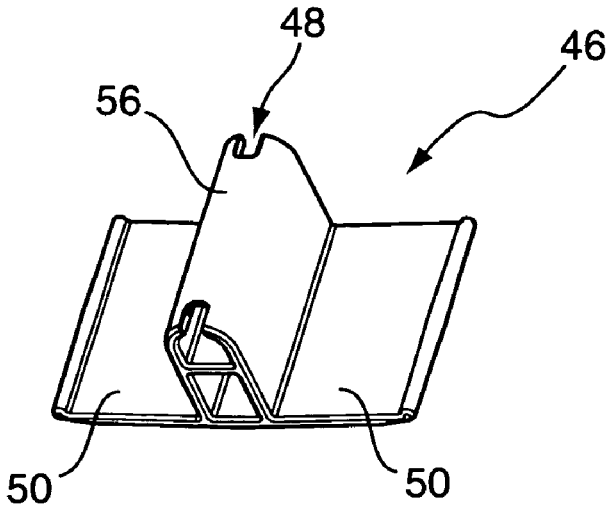
FIG. 11 is a perspective view of a hasp for a fastener for use in an embodiment of the invention.
Figure 12:
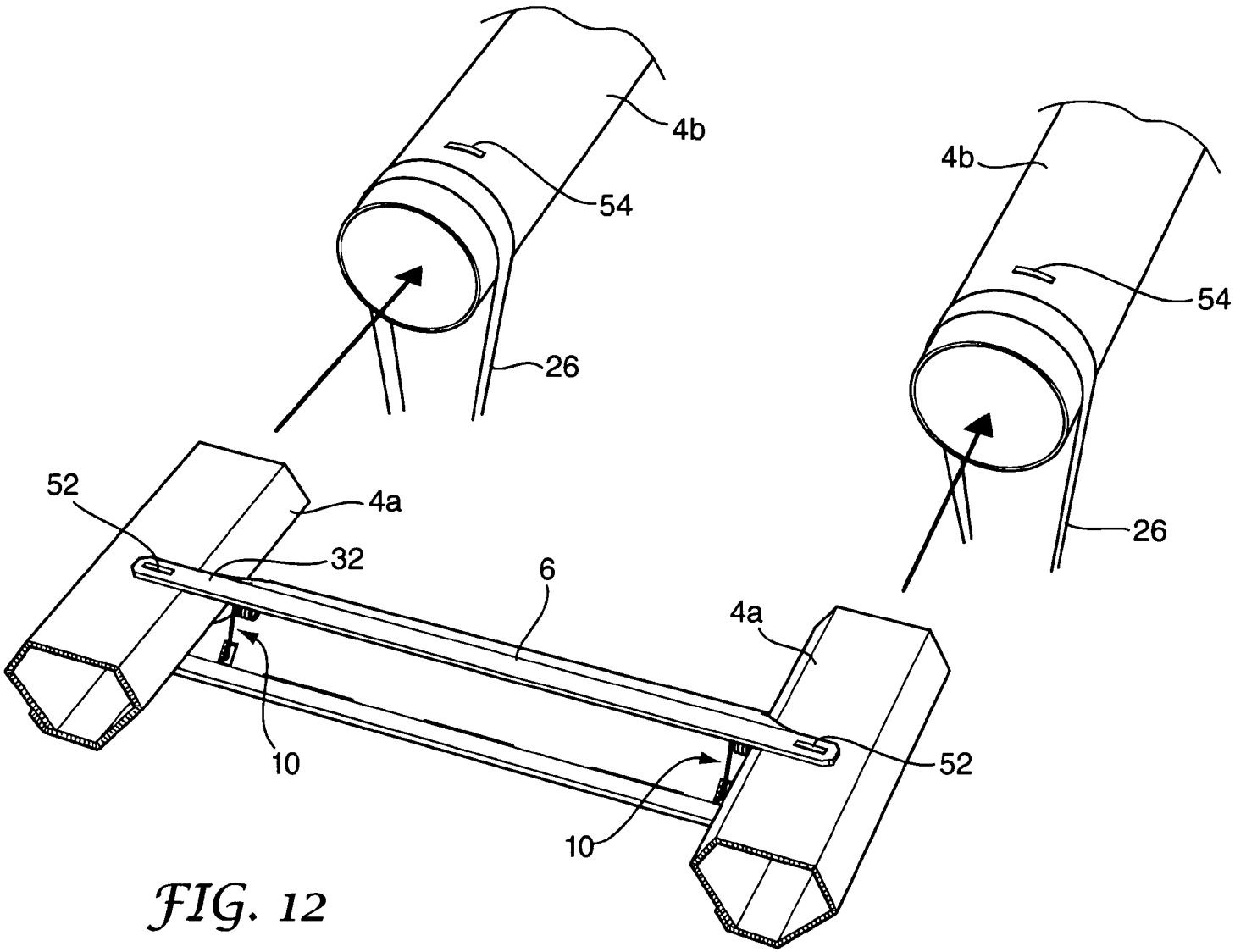
FIG. 12 shows a support device in accordance with another embodiment of the invention.

FIGS. 9 and 10 illustrate fastening means for releasably securing a jaw of an elongate member to an end of a tubular member. The fastening means comprises a hasp 46 which has a central ridge 56 and lateral flanges 50. The ridge 56 has a closed-top channel 48 formed therein for receiving a pin 42. Referring now to the embodiment shown in FIG. 12, each elongate member 32 has a slot 52 through which the ridge 56 of the hasp 46 will be disposed. There is a corresponding slot (not shown) in the inner tubular member 4*a*. By pushing the pin 42 into the channel 48 the inner tubular member 4*a* and the end of the elongate member 32 may be releasably locked together. The pin 42 may optionally be provided with a projecting latch 44 to inhibit or prevent removal of the pin 42 from the channel 48 if desired. Also shown in FIG. 12 are parts of outer tubular members 4*b* which in this example are formed from the woven polypropylene material of the bulk bag (not shown) to which they are attached. Lifting straps 26 of the bag are secured to the edges of the outer tubes 4*b*, in this example by sewing.

To assemble the parts, the inner tubes 4*a*, not attached to the spacer 6, are inserted into the outer tubes 4*b* so that the slots in the inner tubes are in register with corresponding slots 54 in the outer tubes. For each pair of aligned slots, a hasp 46 is inserted in the inner tube and pushed through so that its ridge 56 passes through the inner and outer tubes and is disposed through the slot 54 in the outer tube 4*b*. The spacer 6 is then arranged in position with opposed ends of each elongate member 32 on either side of each outer tube 4*b* and with each slot 52 in register with a corresponding slot 54 in the outer tubes. With the ridges 56 pushed through the slots 52, the locking pins 42 are then pushed fully into the channels 48 so as to secure together the ends of the elongate members, the inner tubular members 4*a* and the outer tubular members 4*b*.

In the absence of an applied load, the spacer 6 holds the inner and outer tubes open, permitting a fork-lift's tines to be inserted into the inner tube 4*a* and progressively through the outer tube 4*b*, which guides the tines through the other lifting straps (not shown) which are secured to the outer tube 4*b*. The bulk bag may then be lifted, with the lifting straps taking the weight.

The inner tube 4*a* may not be needed if the outer tube 4*b* is sufficiently resilient to afford suitable access to the tines when held open by the spacer 6. The outer tube 4*b* may optionally be reinforced or strengthened for this purpose, for example by the provision of one or more internal or external supporting members. In an alternative embodiment, each lifting strap may be provided with a slot, and the jaw members may be secured directly to the lifting straps by means of releasable connecting means such as illustrated in FIGS. 9 and 10, in the manner described above.

It will be appreciated that the inner tube 4*a* may be of any desired length, from a length which projects just beyond the associated lifting strap to a length which extends to the lifting strap at the other end of the external tube 4*b*. The inner tube arrangement shown in FIG. 12 may therefore be used to modify a conventional bulk bag with fabric tubes formed along parallel top edges and carrying a lifting strap at each end. With the spacer 6 holding open the first ends of the tubular members 4, tines may be inserted into the first ends and progressively pushed further through the tubular members, causing them progressively to open up and permit further travel of the tines until the tines are disposed through both pairs of lifting straps. Thus, although it is preferred that the tubular members 4 return to a tubular shape spontaneously when an applied load is removed, this may not be essential providing that the first ends are open to receive the tines.

Figure 13:
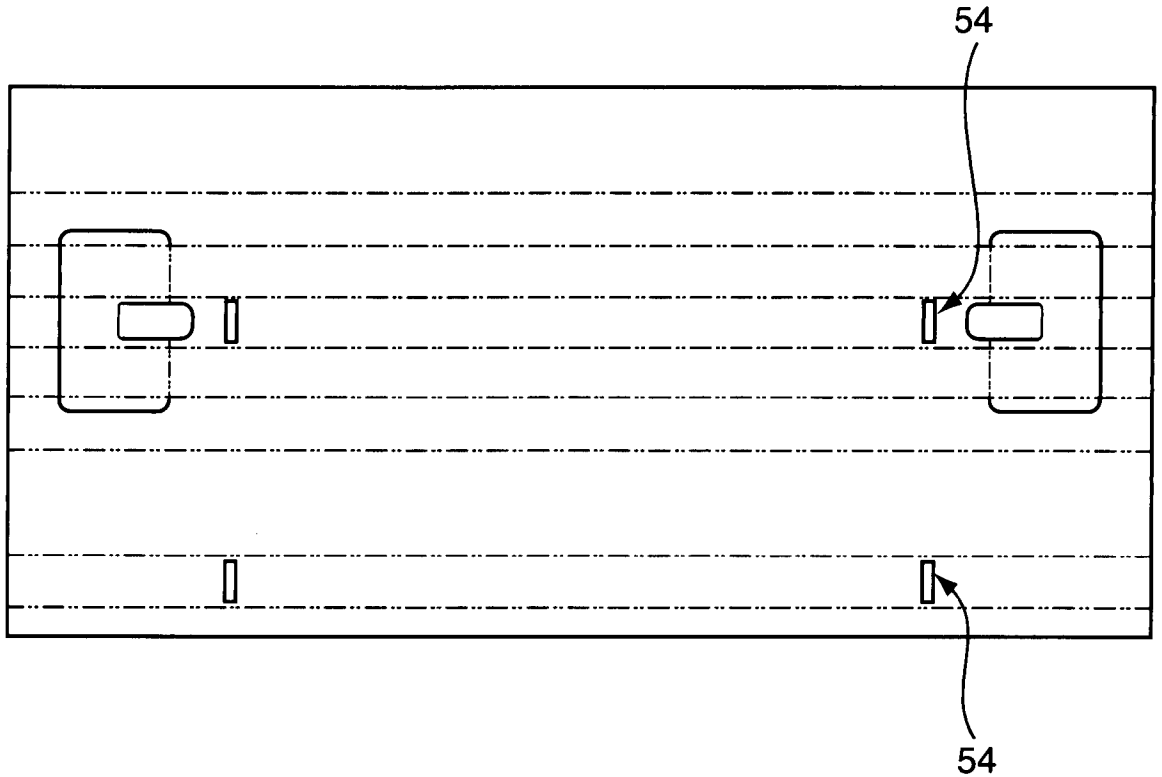
FIG. 13 is a plan view of a blank for making a tubular member of a further embodiment of a support device in accordance with the invention.
Figure 14:
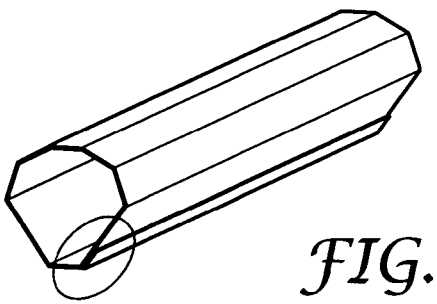
FIG. 14 illustrates a tubular member for use in a support device in accordance with a further embodiment of the invention.
Figure 15:
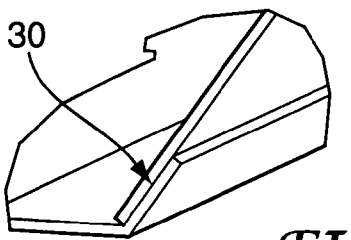
FIG. 15 shows a detail of the tubular member of FIG. 14.

Referring now to FIGS. 13 to 15, an alternative preferred embodiment of tubular member is illustrated. The blank shown in FIG. 13 has axial scores or cuts to form an octagonal tubular member, as shown in FIG. 14. The tubular member is formed from corrugated polypropylene and secured by heat-welding overlapping portions, as illustrated in FIG. 15.

Figure 16:
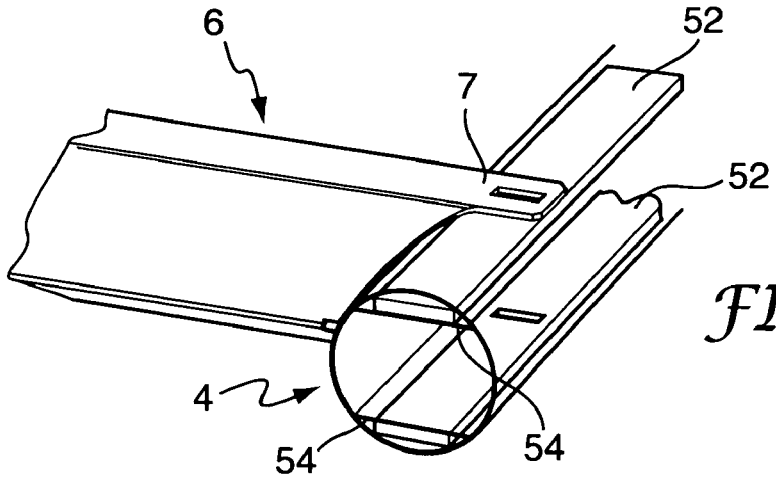
FIG. 16 is a partially cutaway view of part of a bulk bag in accordance with another embodiment of the invention.

FIG. 16 shows an alternative embodiment in which the tubular member 4 is provided with opposed pockets 54. A strengthening member 52, formed from a structural material, for example polypropylene, polyester or polyamide, is held in each pocket and the jaws 7, 9 are releasably secured to the strengthening members.

Figure 17:
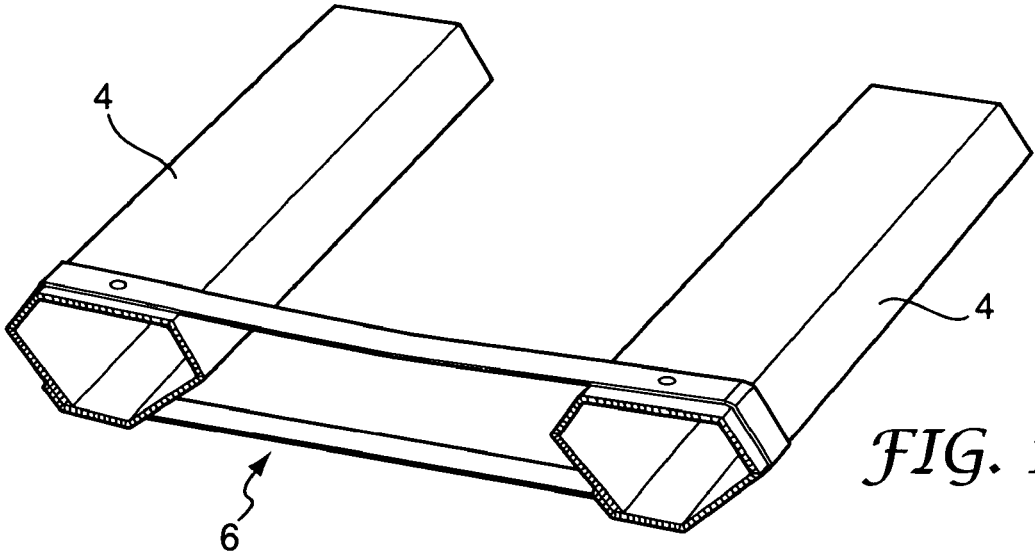
FIGS. 17 and 18 show alternative embodiments of spacers in accordance with aspects of the invention.

FIG. 17 illustrates an alternative embodiment in which the spacer 6 comprises a band of spring metal that surrounds the first end of each tubular member 4. The band and the tubular members lie flat when under a suitable applied load, but the band reverts to the illustrated rest position when the load is removed, causing at least the first end of the tubular members to open up sufficiently to receive a fork-lift tine.

Figure 18:
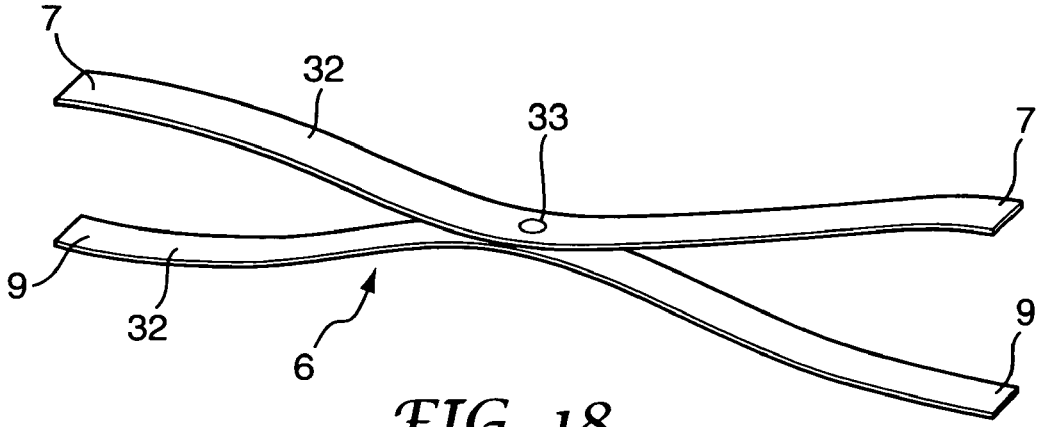

Another alternative embodiment of spacer is shown in FIG. 18. The spacer 6 comprises a pair of elongate members 32 formed from spring metal and joined by fastening means 33, in this example a rivet. As with the embodiment shown in FIG. 17, the spring metal from which the spacer is formed provides the necessary spring means which bias the jaw members 7, 9 to the open position.

Figure 19:
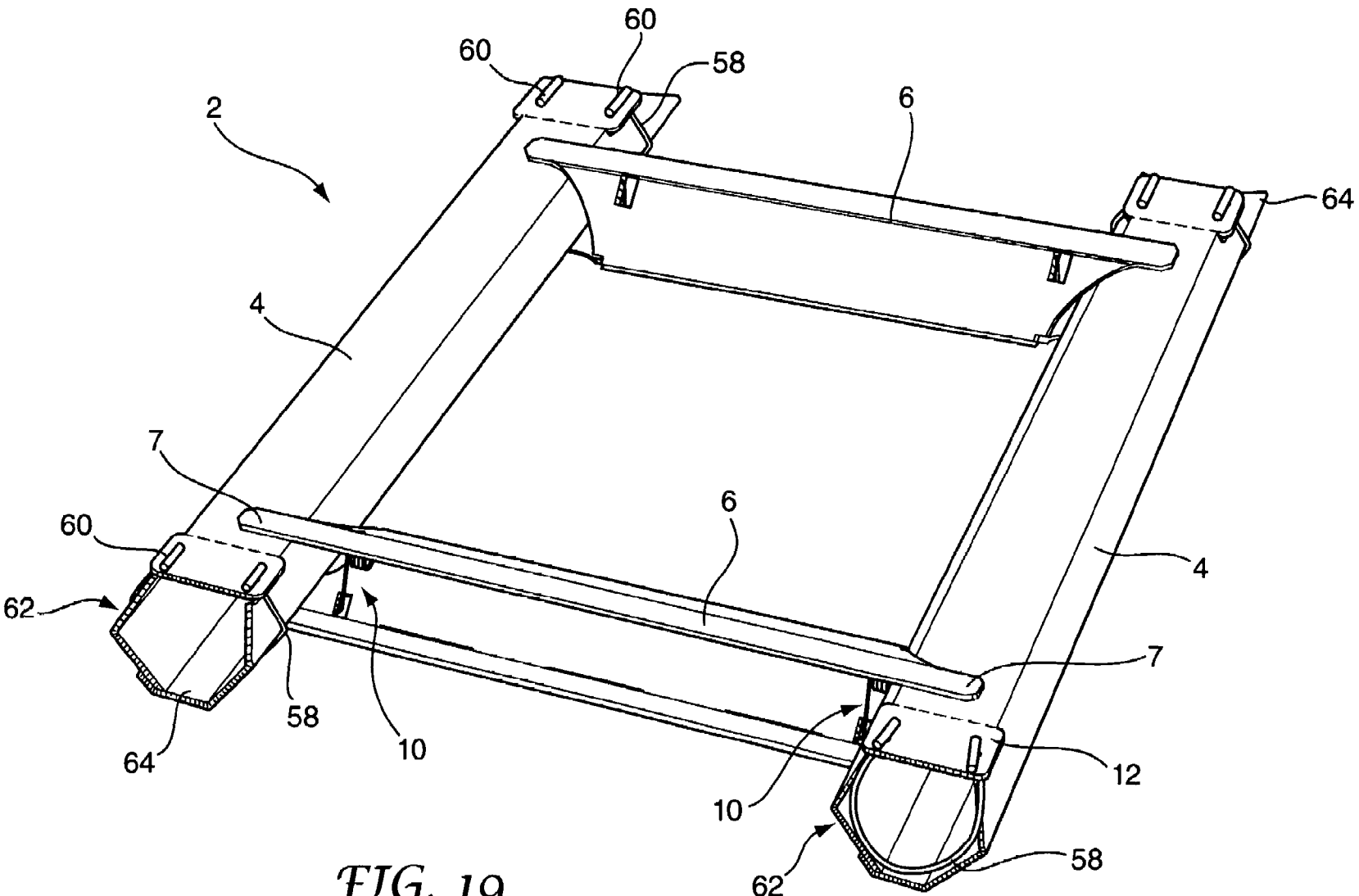
FIG. 19 is a perspective view of a support device in accordance with a preferred embodiment of the present invention.
Figure 20:
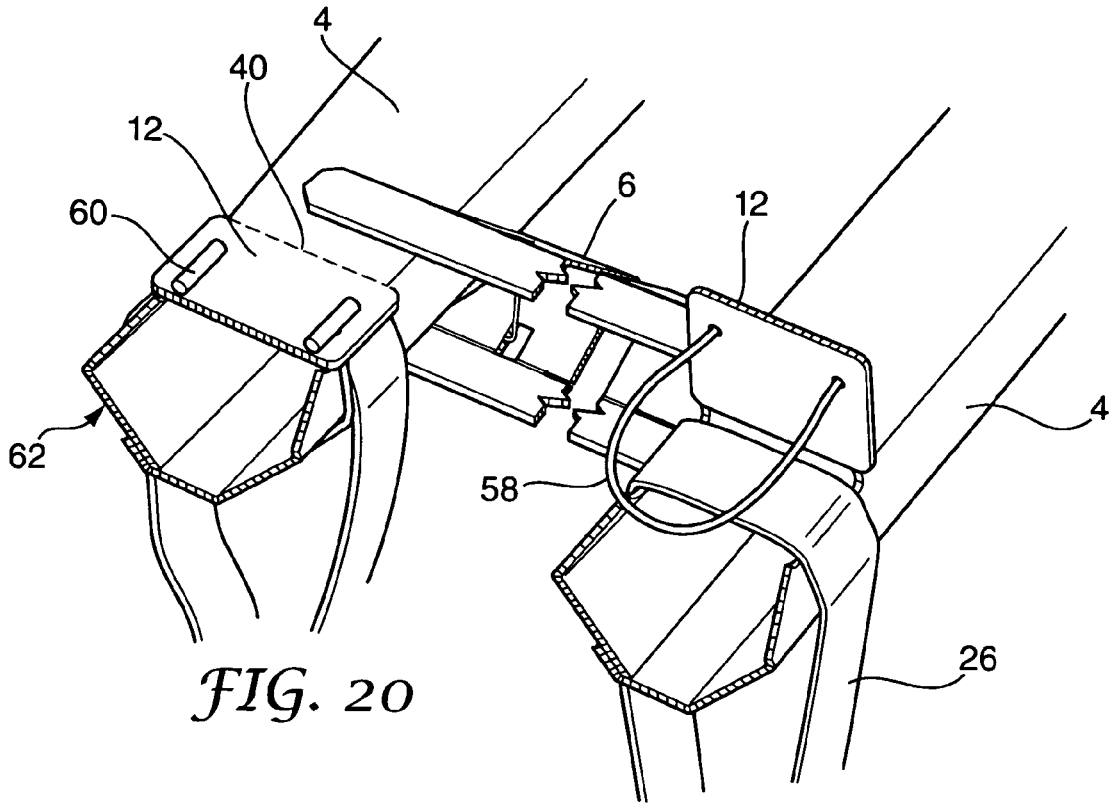
FIG. 20 illustrates stages of the securing of lifting straps of a bulk bag to the support device of FIG. 19.
Figure 21:
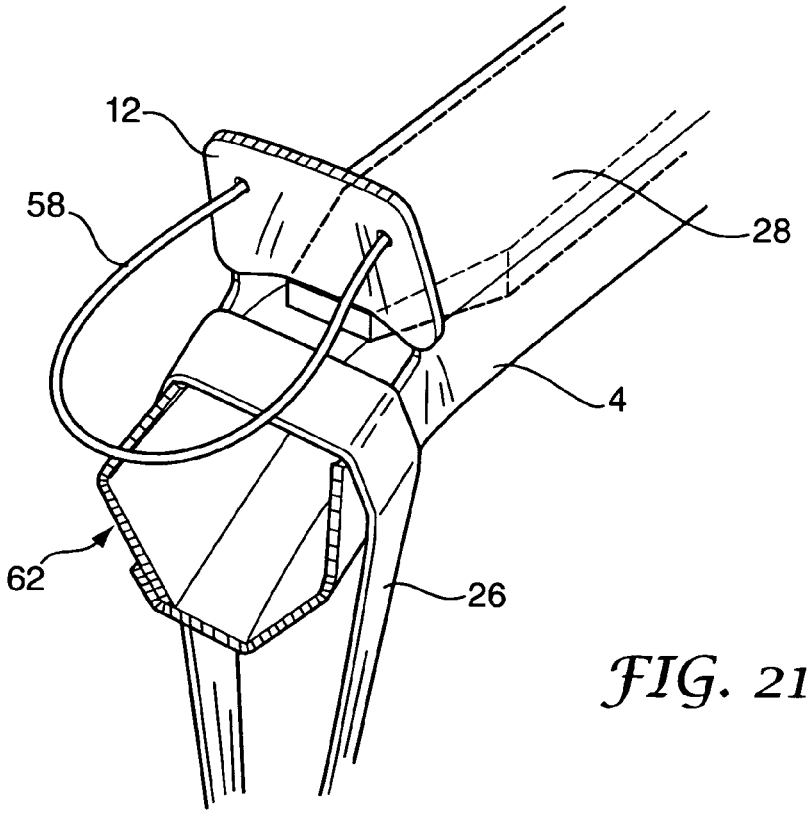
FIG. 21 illustrates the freeing of a lifting strap of the embodiment shown in FIGS. 19 and 20, when a fork-lift tine is not fully inserted.

A preferred embodiment of the invention is shown in FIG. 19, which is similar to that of FIG. 1 but with the following differences. The upper part of each end 62 of each tubular member 4 has a chamfered edge which is cut away to points underneath the strap-cover tab 12. The strap-cover tab 12 is held in place by an elastic loop 58 with toggles 60 at each end, like a large elastic treasury tag. The toggles 60 are axially pushed through holes in the tabs 12 and then turned to retain the loop 58 under the tab 12. As illustrated in FIG. 20, the lifting straps 26 of a bulk bag are secured under the strap-cover tabs 12, and the tabs 12 are then secured in place by pulling the elastic straps 58 underneath the tubular members 4. When the tines of a fork-lift are fully inserted through the tubular members 4 they will engage with the lifting straps 26 and lift the bag as previously described, with the weight being taken by the lifting straps 26. However, if a fork-lift operator does not drive the tines far enough to engage with the rear lifting straps 26, there is a danger that lifting the tines will then cause damage to the top of the tubular members 4. With the preferred embodiment of FIG. 19, such an event will cause the lifting straps 26 to pull on the lower part of the ends 62, while the tines 28 push up on the strap-cover tabs 12. As illustrated in FIG. 21, this will cause the elastic loops 58 to disengage from the tubular members 4 and the tabs 12 to pop open. On seeing the tabs 12 open, the fork-lift operator is alerted to a problem and can lower the tines 28 before damage is done to the tubular members 4. The operator can then re-engage the tabs 12 and elastic loops 58 before proceeding again. In this example the loops 58 are elastic because they are formed from an elastic material. However, it will be understood that the loops 58 could alternatively be elastic by virtue of being formed from a spring material, for example one or more coil springs or other mechanical equivalents.

Another benefit of the embodiment shown in FIG. 19 is that each tubular member 4 has a lower lip 64 which projects beyond the upper part of the tubular member. This feature enables a fork-lift tine to engage initially with the tubular member from above. By doing this, a fork-lift operator does not initially need to engage both tines in the tubular members by driving forward, which may not be feasible if the device 2 is not sitting substantially horizontally. This may be the case when the device is mounted on a bag that is stacked on one or more other bags and is tilted from the horizontal. The lip 64 enables a fork-lift operator to bring the tines 28 down until one of them engages with a lip 64. The fork-lift operator will see that engagement has taken place because the end of the tubular member(s) will be displaced downwardly. If one tubular member 4 is above the other, the upper one will be engaged first and pushed down by the tine. As the tines continue to be lowered, the other tine will subsequently engage with the other lip 64 so that the operator can see that both lips 64 are engaged. The operator can then drive forwards so as to insert both tines 28 into both tubular members 4. The entire process can be a one-man operation.

The invention provides an improved bulk bag, a support device for supporting lifting straps of a bulk bag to facilitate handling by a fork-lift, and a spacer for use in the bag or support device. The support device will lie flat when under load but will reliably raise the lifting straps when the load has been removed, even after a long period of time under load.

While the present invention has been described with reference to specific embodiments, it should be understood that modifications and variations of the invention may be constructed without departing from the true spirit and scope of the invention set forth in the following claims.

What is claimed is:

1. A bulk bag for the storage and transport of bulk materials, comprising:

a bottom panel;

a plurality of side panels;

a pair of substantially parallel collapsible tubular guide members, each tubular guide member having a first end and a second end and being secured on or adjacent to the top of a side panel; and a plurality of lifting straps;

each end of each tubular guide member supporting a lifting strap and the tubular members being connected together by a first spacer;

wherein the first spacer comprises at least one axially stiff elongate member and is provided with a pair of jaws at each end, each pair of jaws comprising a first jaw member and a second jaw member and being adjustable between an open position and a closed position and biased to the open position by spring means;

each pair of jaws being connected to a tubular member at or adjacent to the first end thereof in a manner whereby when the jaws are in the closed position they will cause at least the first end of each tubular member to lie substantially flat and when the jaws are in the open position they will cause or permit at least the first end of each of the tubular members to adopt a shape which is suitable for receiving a tine of a fork-lift.

2. A bag as claimed in claim 1, wherein the spacer comprises a pair of stiff elongate members connected together by a spring means, each end of one of the elongate members comprising one of the said first jaw members and each end of the other elongate member comprising one of the said second jaw members.

3. A bag as claimed in claim 2, wherein the elongate members of each spacer are hingedly connected together.

4. A bag as claimed in claim 1, wherein each tubular member has a slot or cut-out portion adjacent each end for receiving a portion of one of the lifting straps and is provided with a strap-covering tab for each slot or cut-out portion, which is hingedly connected along an edge thereof.

5. A bag as claimed in claim 4, wherein each strap-covering tab is integral with the tubular member and formed by cutting, and wherein each strap-covering tab is provided with a locking tab which is cut out from a region which spans the hinge connection and which locking tab can be tucked under a free edge of the cut-out portion to retain the strap-covering tab over the cut-out portion.

6. A bag as claimed in claim 1, wherein the tubular guide members are connected together at or adjacent to their second ends by a second spacer.

7. A bag as claimed in claim 1, wherein each of said lifting straps is integrated with one of said tubular guide members.

8. A bag as claimed in claim 1, wherein each of said tubular members is integrated with a top edge of a side panel.

9. A bag as claimed in claim 1, wherein at least said first end of each tubular member is provided with a projecting lower lip which, when in use, will permit the tines of a fork-lift to engage with said lips by lowering said tines from above said tubular members.

10. A support device for securing to a bulk bag comprising a bottom panel, a plurality of side panels and a plurality of lifting straps, the device comprising a pair of substantially parallel collapsible tubular guide members each having a first end and a second end and which are connected together by a first spacer;

wherein the first spacer comprises at least one axially stiff elongate member and is provided with a pair of jaws at each end, each pair of jaws comprising a first jaw member and a second jaw member and being adjustable between an open position and a closed position and biased to the open position by spring means;

each pair of jaws being connected to a tubular member at or adjacent to the first end thereof in a manner whereby when the jaws are in the closed position they will cause at least the first end of each tubular member to lie substantially flat and when the jaws are in the open position they will cause or permit at least the first end of each of the tubular members to adopt a shape which is suitable for receiving a tine of a fork-lift.

11. A device as claimed in claim 10, wherein the first spacer comprises a pair of stiff elongate members connected together by a spring means, each end of one of the elongate members comprising one of the said first jaw members and each end of the other elongate member comprising one of the said second jaw members.

12. A device as claimed in claim 11, wherein the elongate members of the first spacer are hingedly connected together.

13. A device as claimed in claim 11, wherein the elongate members are formed from a corrugated plastics material.

14. A device as claimed in claim 13, wherein the spring means comprises at least one coil spring having free ends provided with barbs and wherein the or each spring is connected between the elongate members by engagement of the barbs in channels in the elongate members.

15. A device as claimed in claim 10, wherein the spring means comprises at least one coil spring.

16. A device as claimed in claim 10, wherein the tubular members have a hexagonal cross section.

17. A device as claimed in claim 10, wherein the tubular members have an octagonal cross section.

18. A device as claimed in claim 10, wherein the tubular members are formed from a corrugated plastics material.

19. A device as claimed in claim 10, wherein the tubular members are securable to the side panels of a bulk bag by means of the lifting straps.

20. A device as claimed in claim 19, wherein each tubular member has a slot or cut-out portion adjacent the first and second ends for receiving a portion of a lifting strap of a bulk bag and is provided with a strap-covering tab for each slot or cut-out portion, which is hingedly connected along an edge thereof.

21. A device as claimed in claim 20, wherein each strap-covering tab is integral with the tubular member and formed by cutting, and wherein each strap-covering tab is provided with a locking tab which is cut out from a region which spans the hinge connection and which locking tab can be tucked under a free edge of the cut-out portion to retain the strap-covering tab over the cut-out portion.

22. A device as claimed in claim 19, wherein at least one tubular member has a slot or cut-out portion adjacent at least one of said first and second ends for receiving a portion of a lifting strap of a bulk bag and is provided with a strap-covering tab for said slot or cut-out portion, which is hingedly connected along an edge thereof;

wherein said strap-covering tab is provided with a an elastic loop for releasably holding said tab down when said elastic loop is disposed around said tubular member; and wherein said tubular member has a chamfered or tapered portion extending upwardly in use from said end to said slot or cut-out portion.

23. A device as claimed in claim 10 wherein the tubular guide members are connected together at or adjacent to their second ends by a second spacer.

24. A device as claimed in claim 10, wherein each tubular guide member comprises an outer tube and an inner tube which are connected together, the first spacer being connected to at least one of the inner tube and the outer tube of each guide member.

25. A device as claimed in claim 24, wherein a single fastening releasably connects a jaw member of the first spacer together with the inner tube and the outer tube.

26. A device as claimed in claim 10, wherein at least said first end of each tubular member is provided with a projecting lower lip which, when in use, will permit the tines of a fork-lift to engage with said lips by lowering said tines from above said tubular members.

27. A support device for securing to a bulk bag, the device comprising a pair of substantially parallel collapsible tubular guide members which are connected together at or adjacent to each end by spacers;

wherein each spacer comprises a pair of stiff elongate members connected together by a spring means;

each elongate member of each spacer being connected to each tubular member at a different location to that to which the other elongate member is connected;

whereby the support device will lie flat when under a suitable load but the spring means will cause the elongate members of each spacer to move apart relative to one another when the load is removed, thereby causing the tubular members to adopt a shape which is suitable for receiving and guiding the tines of a fork-lift.

28. A bulk bag for the storage and transport of bulk materials, comprising:

a bottom panel;

a plurality of side panels;

a pair of substantially parallel collapsible tubular guide members, each tubular guide member having a first end and a second end and being secured on or adjacent to the top of a side panel; and a plurality of lifting straps;

each end of each tubular guide member supporting a lifting strap and the tubular members being connected together by a first spacer;

wherein at least said first end of each tubular member is provided with a projecting lower lip which, when in use, will permit the tines of a fork-lift to engage with said lips by lowering said tines from above said tubular members;

and wherein said first spacer comprises at least one axially stiff elongate member and is provided with a pair of jaws at each end, each pair of jaws comprising a first jaw member and a second jaw member and being adjustable between an open position and a closed position and biased to the open position by spring means;

each pair of jaws being connected to a tubular member at or adjacent to the first end thereof in a manner whereby when the jaws are in the closed position they will cause at least the first end of each tubular member to lie substantially flat and when the jaws are in the open position they will cause or permit at least the first end of each of the tubular members to adopt a shape which is suitable for receiving a tine of a fork-lift.

29. A support device for securing to a bulk bag, the device comprising:

a pair of substantially parallel collapsible tubular guide members which are connected together at or adjacent to each end by spacers;

each tubular member being provided with a projecting lower lip which, when in use, will permit the tines of a fork-lift to engage with said lips by lowering said tines from above said tubular members;

each spacer comprising a pair of stiff elongate members connected together by a spring means;.

each elongate member of each spacer being connected to each tubular member at a different location to that to which the other elongate member is connected;

whereby the support device will lie flat when under a suitable load but the spring means will cause the elongate members of each spacer to move apart relative to one another when the load is removed, thereby causing the tubular members to adopt a shape which is suitable for receiving and guiding the tines of a fork-lift.

30. A bulk bag for the storage and transport of bulk materials, comprising:

a bottom panel;

a plurality of side panels;

a pair of substantially parallel collapsible tubular guide members, each tubular guide member having a first end and a second end and being secured on or adjacent to the top of a side panel; and a plurality of lifting straps;

each end of each tubular guide member supporting a lifting strap and the tubular members being connected together by an axially stiff elongate first spacer which is provided with a pair of jaws at each end, each pair of jaws comprising a first jaw member and a second jaw member and being adjustable between an open position and a closed position and biased to the open position by spring means;

each pair of jaws being connected to a tubular member at or adjacent to the first end thereof in a manner whereby when the jaws are in the closed position they will cause at least the first end of each tubular member to lie substantially flat and when the jaws are in the open position they will cause or permit at least the first end of each of the tubular members to adopt a shape which is suitable for receiving a tine of a fork-lift.

* * * * *